United States Patent [19]

Kelly

[11] 3,959,113

[45] May 25, 1976

[54] SQUARE FORM PERMEABLE ELECTRODES FOR PRESSURE ELECTROLYSIS PROCESS UNITS

[76] Inventor: Donald A. Kelly, 58-06 69th Place, Maspeth, N.Y. 11378

[22] Filed: Feb. 19, 1975

[21] Appl. No.: 551,044

[52] U.S. Cl. ..... 204/278; 204/284; 204/242

[51] Int. Cl.[2] ..... C25B 11/03

[58] Field of Search ..... 204/129, 242, 256, 257, 204/266, 270, 278, 283, 284, 285

[56] References Cited

UNITED STATES PATENTS

| | | | |
|---|---|---|---|
| 1,401,035 | 12/1921 | Boisen | 204/278 |
| 2,691,628 | 10/1954 | Aannerud | 204/283 |
| 2,921,894 | 1/1960 | O'Callaghan | 204/284 |
| 3,188,283 | 6/1965 | Cole | 204/129 |
| 3,342,717 | 9/1967 | Leduc | 204/266 |
| 3,523,884 | 8/1970 | Bagno | 204/284 |

*Primary Examiner*—T. Tung

[57] ABSTRACT

The square form of permeable electrode is advocated for use in pressure electrolysis process units for high, uniform hydrogen and oxygen gas yields per unit area of exposed electrode surfaces.

The square form electrode assures uniform electrical conductive flow between the narrow electrolyte gaps between each face of the square anodes and cathodes for even gas molecule polarization.

Both thin wall porous rectangular metallic sheets, or extruded square porous metal tubes can be used, or fine mesh monel screening of 400 mesh size may be the electrode material.

The total exposed electrode surface area must be as large as possible compared to the overall cell unit size and electrolyte volume.

10 Claims, 4 Drawing Figures

SQUARE FORM PERMEABLE ELECTRODES FOR PRESSURE ELECTROLYSIS PROCESS UNITS

BACKGROUND OF THE INVENTION

One hopeful area of accelerated hydrogen generation which has not been sufficiently explored and developed to date is the combined collection by polarization and pressure permeation of hydrogen molecules through selective permeable elements of various types. Only a slight amount of continual pressure exerted on the sealed electrolyte will be necessary to provide successive gas molecule passage through the porous electrode surfaces.

When the basic electrolysis function is combined with pressure-permeation, the gas molecules collect of each respective electrode surface and it is then possible to successively push the molecules through the electrode walls with a light pressure.

The electrode walls must be extremely thin and have a critical porosity factor in order to facilitate the passage of the hydrogen (and oxygen) molecules, to the total exclusion of the water molecules.

The present difficulties with this concept are that the actual gas yields will be relatively small per unit surface area of each electrode, with the possibility of progressive clogging of the permeable passages, or grids of the electrode surfaces.

A critical relationship exists for the electrode permeable passages (porosity), size, between the necessity for the total exclusion of the water molecule, and the need to maintain a maximum gas molecule transfer without any clogging.

Another critical aspect is the importance of maintaining adequate distributed electrical polarity means to densely attract the hydrogen and oxygen molecules within the passage path or grid.

This present square form of permeable electrode for the pressure electrolysis units has been evolved from the necessity of maintaining uniform electrical conductivity over the electrode surfaces for the electrolysis function of the pressure electrolysis units.

In the conventional electrolysis process it is known that unless each anode and opposite cathode surface is exactly flat and parallel, the electrical flow tends to pass across the shortest distance between the corresponding electrode surface a, and thereby progressively erode the local electrode metal at the "high" points.

This condition will materially shorten the useful service life of each electrode tube and cause the production of unpure gases at uneven flow rates.

The previously disclosed tubular electrodes will be less effective due to this problem, and will have shortened service life, unless some form of compensation means is provided in the fabrication of these round tubes.

Obviously, the present square-form of hollow electrode type will satisfy this operational condition when the multiple, identical square electrodes are set up in a square or rectangular-pattern within the pressure electrolysis cell units.

Various types of permeable electrode tubes have been evolved to support ad facilitate the development of the combined pressure-electrolysis process concept. The previous electrodes which were proposed involved the use of differing porosity ranges of thin-wall sintered tubes with external anti-caustic coatings. The metal selected for these tubes was either pure nickel or monel, since these are economically practical, and nearly noble, rather than platinum or palladium which are highly noble and therefore used for electrolysis electrodes, or for the permeation of the hydrogen molecule, respectively.

A later variation for the electrode material has been the use of fine wire mesh, seive cloth of about 400 mesh, which has the ability to prevent water molecule passage, while allowing the permeation of either hydrogen or oxygen molecules under pressurization.

The further development of the fine wire mesh cloth or screening for permeable electrodes appears most promising, since this approach would provide a near absolute minimum wall thickness, which is structurally and electrically sound.

A further benefit presented by the use of controlled diameter fine wire and mesh or grid opening size is that the fabrication techniques can be more closely controlled to produce uniform materials in production runs, compared with the more random sintered metal method in the 0.5 micron range.

The exact final mesh or porosity factor for the electrodes must be determined through successive testing and comparison, along with the percentage of electrolyte solution compatible with this combined process. Estensive life testing will be required to determine life-degrading and erosion factors, along with progressive passage restriction build-up.

The conceptral basis for the combined pressure-permeation electrolysis process is to accelerate the gas molecule passage through permeable elements, using external pressurizing means, as additional input energy means in lieu of a portion of the expensive electrical energy.

The substitution of some other convenient, low-cost energy source for a portion of the electrical input energy is attractive for further development effort to achieve the end results for the process concept.

The water-electrolysis function is basically clean and simple for obtaining both pure hydrogen and oxygen, and lends itself to various improvement modifications, such as the applying of heat energy, internal and external pressurization, and other energy forms.

SUMMARY OF THE INVENTION

By constructing the conventional electrolysis electrodes as porous, square-form, electrically-conductive elements, a combined pressure-permeation and electrolysis function can be achieved, which will provide an increased hydrogen and oxygen separation rate for a fixed given input of low-voltage D.C. power, to the cell unit.

The square-form permeable electrodes for the pressure-electrolysis process units are advocated for producing relatively high yields of hydrogen and oxygen gases per unit electrode surface area.

This type of square form electrode would replace the previously disclosed tubular electrodes which are now considered to be far less effective because of the non-uniform electrical flow factor, as previously described in the background material.

By adopting square shaped, elongate hollow electrodes, an added fabrication method is open for their constrction. The usual method of forming the porous sintered metal can be utilized, or the square form electrodes may be built up of flat, rectangular metallic sheets and then bonded and sealed into the square configuration electrodes.

Any subsequent anti-caustic clogging exterior coating layer-treatment or surface cladding which was advocated for the previous tubular electrodes is also applicable to these newer square-form electrodes.

Since the basic criterion for the electrode porosity is the prevention of water electrolyte leakage into the hollow electrode cavity, at the working pressure range, an extremely fine porous structure is necessary for the square form electrodes.

The porosity range for the cathode (hydrogen) electrodes has been set in the 0.5 micron range for a pressure range of from 5 to 15 psi, which is the tentative cell unit working pressure range. The anode (oxygen) electrodes are set in the 1 micron range in the same pressure range.

Because nearly the lowest possible porosity rating (0.5 microns) for the porous electrodes is now being used for this application based on current technology, the only other working variables for the permeation rate will be the restriction cause by the surface anti-caustic clogging coating, and variation of the working pressure.

Each porous square-form electrode is polarized as the cathode (hydrogen passage), and anode (oxygen passage), for the electrolysis function of the combined process.

The sets of cathode and anode square form electrodes are lined up in square or rectangular rows within the combined process tank, in the preferred form of the process. Each square form electrode is uniformly secured to a top pressure plate, near the top of each electrode, so that the major portion of the electrodes are immersed in the electrolyte solution within the process tank.

The top pressure plate matches and exactly fits on the top of flat flanges, on the top of the process tank, and seals the tank from electrolyte spillage.

Positive and negative electrical connections are made to each anode and cathode square form electrode, respectively, near the top of the electrodes to maintain the continuing electrolysis function.

In the preferred single process tank arrangement, the hydrogen and oxygen gases flow upward through the insides of each square form electrode, and are collected in two horizontal manifold tubes which are directly connected to each electrode, at the top edges. The protruding portion of each square form electrode is sealed around the outer surfaces, so that no gas escapes before the gases enter each upper manifold tube.

An important factor in the placement of the electrodes within the process tank is that they be closely positioned to each other for a uniform, close electrolyte gap in the range of about ⅛ to ¼, on all four sides.

These small uniform electrolyte gaps will minimize electrical resistance through the electrolyte solution, and reduce the total volume of electrolyte solution required, to facilitate pressurization and displacement responsiveness.

This arrangement provides a large exposed surface area for the electrodes in the combined process, and high permeable surface area to electrolyte volume ratio, in a basically simple process and equipment package.

Because nearly to the lowest possible porosity rating — (0.5 microns) is now being used for the cathode permeable electrodes, which may not be ideal to meet the dense molecular attraction requirement, the fine wire mesh material for the electrodes is now considered to be closer to an ideal electrode construction approach.

If a fine wire mesh seive cloth of about 400 mesh or less is formed into a square box-like electrode the water molecules will not pass through, but hydrogen and oxygen molecules may readily pass or permeate through the grid openings under light pressure.

The application of fine wire mesh will provide a near absolute minimum wall thickness which is mechanically and electrically useful and sound. Since the fine wires of about 0.001 diameter are smoothly cold extruded they are durable and uniform in size, so that when woven into controlled mesh with an approximate opening or grid of 0.0015 inch, they will provide effective permeable electrode surfaces.

Because the fine wire mesh surfaces are not self-supporting they must be backed up by an inner core or framework which has multiple thin ribs to uniformly support the wire mesh surfaces, and form the gas collection rising paths.

It is preferable that the framework be made of non-conductive (electrical) material, so that electrical conductivity is confined to the outer fine wire mesh surfaces only for uniform electrical flow where it is required.

The one piece fine wire mesh would be formed around the core framework and joined at one corner only, so that there is no interruption in the four electrode surfaces. The two joining sides are made slightly longer than the basic side widths, so that two joining tabs are provided which are bonded together with special epoxy cement.

Each electrode fine wire mesh surface fold must be "overformed", or made slightly smaller than 90°, so that when placed in position on the core framework the surface will remain flat and true on the core framework.

The bottom and tops of the fine wire mesh edges must be joined and sealed to the corresponding bottom and top core square end pieces, so that no leakage occurs at these points.

The closeness or density of the cross-ribbing between the core frame uprights must be located to adequately support the fine wire mesh surfaces against the working pressure within the process tank.

The electrical connections to each of the square form electrodes is made in the same way as for the previous tubular electrodes, which was between the top pressure plate and the upper gas collection manifold, horizontal tubes. The fine wire mesh area in the zones between the top pressure plate and the upper gas collection manifold tubes is sealed against gas leakage, as in the previous arrangement.

The fine wire must be made of monel or pure nickel which have near nobility to prevent undue erosion from the caustic action of the electrolyte solution, and are economically practical for the electrodes of the process.

For the porous type of permeable electrodes, the adoption of the square configuration allows two forms of electrodes to be fabricated the first would be the usual formed (sintered) porous metal type, and as an alternative, the built up electrode of flat rectangular sheets which are joined and sealed at the corners to produce the square form electrodes.

Monel or pure nickel must also be used for the porous type of electrodes, and must be made in a range of from 0.007 to 0.010 thick, in order to achieve an optimum gas molecule passage rate, while maintaining structural integrity.

It is important to the proper functioning of the combined process unit that a constant gas flow balance be maintained between the cathodes (hydrogen) and anodes (oxygen), so that the electrolyte solution is uniformly depleted and replenished.

To this end, the porosity of the anodes may have to be slightly larger (approx. 1 micron) to facilitate the larger oxygen molecule passage, in balance with the hydrogen molecule permeation.

The electrolyte solution must also be maintained at a nearly constant percentage, so that the electrolysis rate and caustic level is kept uniform at all times.

All of the functional components of the combined pressure electrolysis process have been disclosed in previous specifications, and will remain basically the same for this present type of square form electrode.

A supplementary feature for the fine wire mesh electrodes would be the random placement of short, fine wire whiskers within the tiny grid openings to act as hydrogen and oxygen "attractors".

This tiny horizontal wire "attractor" may hasten hydrogen and oxygen passage through the grid openings, and further restrict the grid opening if necessary. The placement of the tiny round wire into the square grid opening would leave four corner passages open for molecular passage.

It is a principal objective of this present invention to significantly increase the gas yields, both hydrogen and oxygen, for the combined pressure-permeation electrolysis process, as previously disclosed.

It must be understood that design variations may be made in the detail features of the square-form permeable electrodes, without departing from the spirit and scope of the invention, as specified.

DESCRIPTION OF THE PREFERRED EMBODIMENT

Figure 1:
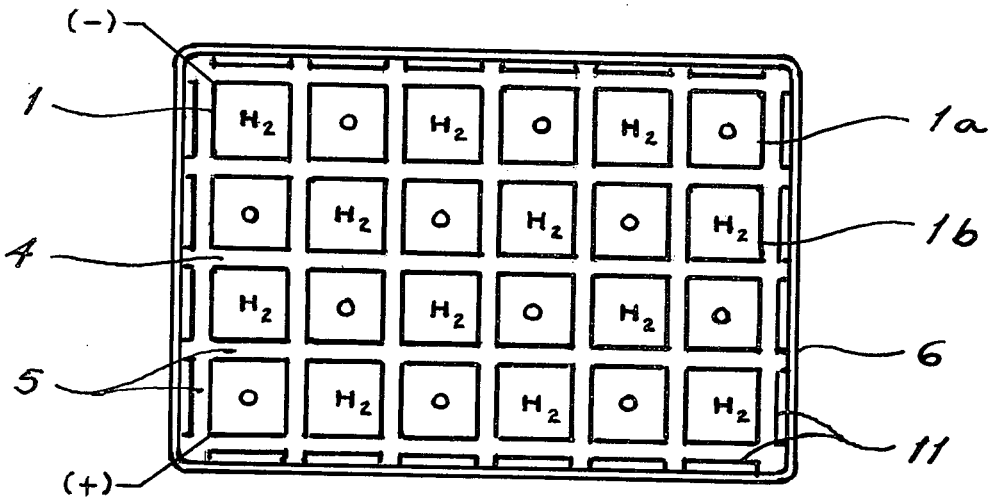
FIG. 1 is a top section view through the corresponding sets of cathodes and anodes within the process tank.
Figure 2:
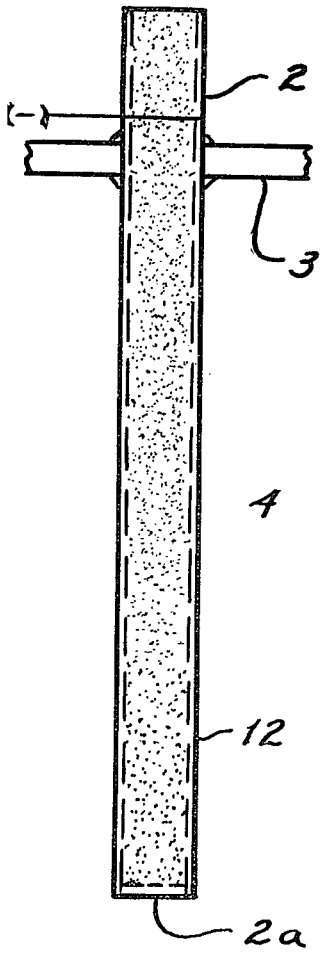
FIG. 2 is an elevation exterior view of the porous metal square form permeable electrodes.
Figure 3:
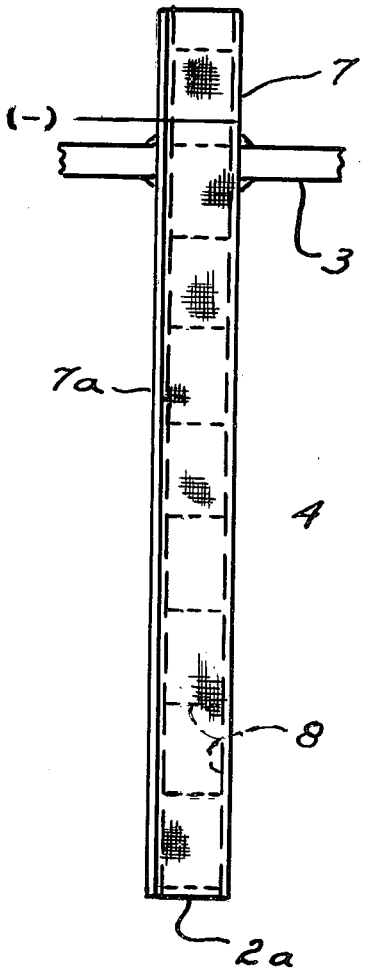
FIG. 3 is an elevational exterior view of the fine wire mesh square form permeable electrodes.
Figure 4:
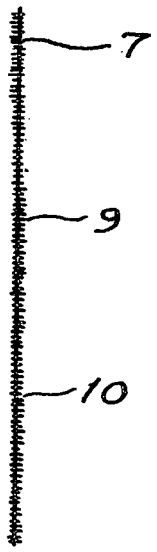
FIG. 4 is a detail view of the fine wire whisker attractors within a fine wire mesh electrode surface.

The square form permeable electrodes for pressure electrolysis process units consist of multiple square-form permeable electrodes 1, which may be made by several methods.

The basic type of square form permeable electrode would consist of formed porous metal made in one piece, square shaped elongated element 2, or this type may be made up of four equal flat, rectangular pieces which are bonded and sealed together at the corners, to form the square electrode 1.

A bottom square, non-permeable piece 2*a* is bonded and sealed to the bottom of each electrode tube 2, to prevent electrolyte solution from entering the electrode at these points.

Each square form anode 1*a*, and opposite cathode 1*b*, are lined up in rows and columns within a top pressure plate 3, near the ends of each electrode, so that the major portions of the electrodes are exposed to the electrolyte solution 4, within the process tank 6. The electrodes 1 are accurately located square and parallel within the electrolyte solution 4, so that the electrolyte gaps 5 are identical and parallel.

Another type of square form electrode would consist of fine wire mesh of about 400 mesh size 7, which is secured and sealed to a core framework 8 to provide adequate support, alignment and flatness for the fine wire mesh 7.

The core framework 8 is made up of interlocking, non-conductive vertical strips and equally spaced horizontal ribs, which prevent the fine wire mesh from being push inwardly by the pressure of the electrolyte solution 4.

Joining tabs 7*a* are provided at the ends of each fine wire mesh 7, so the these ends may be joined and sealed around the core framework 8.

Fine, short length cross wire whiskers 9 as molecule attractor are closely fitted into random grid openings 10 within each fine wire mesh 7 face to attract the hydrogen and oxygen molecules.

In order to provide high density exposed electrode surfaces, single face electrodes 11 are uniformly provided around the inside periphery of the process tank 6.

These single face electrodes 11 line up with opposite square form electrodes 1 and extend the full vertical height of the process tank 6.

A sub-surface, anti-clogging layer 12 may be impregnated into the porous type of metal electrodes 2, as required to reduce clogging.

What is claimed is:

1. An apparatus comprising multiple square form permeable electrodes equally divided into alternate opposite cathodes and anodes, each electrode being one hollow porous metal piece and having a wall thickness not less than 0.007 inch and not more than 0.010 inch, a square non-permeable thin plate bonded and sealed to the bottom of each of said electrodes, a top pressure plate for accurately locating and mounting each of said multiple square form permeable electrodes into precise alternate opposite rows and columns of anodes and cathodes, bonding and sealing means joining each of said multiple square form permeable electrodes into said top pressure plate, a process tank of rectangular form containing all said multiple square form permeable electrodes, and sealing means joining said top pressure plate into said process tank of rectangular form.

2. The apparatus according to claim 1, in which all of said cathodes are made of pure sintered nickel metal with a porosity of 0.5 micron, all of said anodes are made of pure sintered nickel metal with a porosity of 1 micron, said multiple square form permeable electrodes being mounted near one end therefore into said top pressure plate, and the short protruding ends of said multiple square form permeable electrodes above said top pressure plate being sealed to prevent gas leakage.

3. The apparatus according to claim 1, wherein each of said cathodes and anodes is provided with a sub-surface anti-clogging plastic layer on the inside surfaces thereof.

4. The apparatus according to claim 1, in which all of said cathodes are connected to a negative electrical lead from an external low-voltage D.C. power source, all of said anodes are connected to a positive electrical lead from the same external low-voltage D.C.

power source, and terminal and insulation means for the electrical leads are provided.

5. The apparatus according to claim 1, wherein each electrode is made from four elongated flat rectangular porous metal pieces joined and sealed at the four corners.

6. Multiple elongated square form permeable electrodes each comprised of fine wire mesh sieve cloth of 400 mesh size made in one rectangular piece for pressure-electrolysis process units, said fine wire mesh sieve cloth of 400 mesh size having three vertical folds to form a square box-like pattern, a vertical elongated core framework consisting of four vertical members with uniformly spaced horizontal ribs disposed between said four vertical members, two joining tabs disposed at the ends of said fine wire mesh sieve cloth of 400 mesh size for joining and sealing around said core framework, bonding and sealing means securing said fine wire mesh sieve cloth of 400 mesh size around said vertical elongate core framework to form said electrode, a bottom square non-permeable thin plate bonded and sealed to the bottom of each of said formed electrode.

7. Multiple elongated square form permeable electrodes according to claim 6, in which the said wire mesh sieve cloth is made of fine monel wire.

8. Multiple elongated square form permeable electrodes according to claim 6, in which fine short length cross wire whiskers are randomly disposed at right angles into the grid openings of said fine wire mesh sieve cloth, said cross wire whiskers are nearly 0.0015 inch in diameter to closely fit into the grid openings of said fine wire mesh sieve cloth.

9. Multiple elongated square form permeable electrodes according to claim 6, in which half of said electrodes are connected to a negative electrical lead from an external low-voltage D.C. power source as cathodes, and the other half of said electrodes are connected to a positive electrical lead from the same external low-voltage D.C. power source as anodes.

10. An apparatus wherein the electrodes of claim 6 are mounted near one end thereof into a top pressure plate, bonding and sealing means joining each of the electrodes to said top pressure plate, the short protruding ends of said electrodes being sealed to prevent gas leakage, a process tank of rectangular form and open at the top containing said electrodes, sealing means joining said top pressure plate to said process tank, and an anti-clogging plastic coating for each of said multiple square form permeable electrodes uniformly disposed over all exposed surfaces.

* * * * *